US012655578B2

(12) United States Patent
Gupta et al.

(10) Patent No.: US 12,655,578 B2
(45) Date of Patent: Jun. 16, 2026

(54) MAGIC BINDING MAKER

(71) Applicant: GHI Inc., Schaumburg, IL (US)

(72) Inventors: Nikhil Gupta, Kildeer, IL (US); Jared Fritts, Downers Grove, IL (US); Ron Farnum, Glen Ellyn, IL (US)

(73) Assignee: GHI Inc., Schaumburg, IL (US)

( * ) Notice: Subject to any disclaimer, the term of this patent is extended or adjusted under 35 U.S.C. 154(b) by 0 days.

(21) Appl. No.: 18/889,840

(22) Filed: Sep. 19, 2024

(65) Prior Publication Data

US 2025/0092598 A1 Mar. 20, 2025

Related U.S. Application Data

(60) Provisional application No. 63/583,704, filed on Sep. 19, 2023.

(51) Int. Cl.
*D06J 1/10* (2006.01)
*B65H 45/30* (2006.01)

(52) U.S. Cl.
CPC ..... *D06J 1/10* (2013.01); *B65H 45/30* (2013.01)

(58) Field of Classification Search
CPC ..... B65H 45/30; B65H 45/12; B65H 45/22; B65H 2301/451; B65H 2701/174; B65H 45/08; B31F 1/2877; B31F 1/2859; B31F 1/2881; B31F 7/00; B31F 7/02; D06J 1/10
USPC ..... 493/405, 406, 436, 438, 439, 446, 455, 493/937; 223/37
See application file for complete search history.

(56) References Cited

U.S. PATENT DOCUMENTS 1,018,227 A 2/1912 Althen
1,357,757 A * 11/1920 Willner ..... B65H 45/101 242/538
1,723,543 A 8/1929 De Santis
2,712,933 A * 7/1955 Davidson ..... E04F 21/00 493/406
2,929,303 A 3/1960 Armstrong
5,554,095 A 9/1996 Matsuo
(Continued)

OTHER PUBLICATIONS

Everything You Need to Know About Duct Tape | RS. (Sep. 4, 2023,). RS. Retrieved Dec. 23, 2024, from https://uk.rs-online.com/web/content/discovery/ideas-and-advice/duct-tapes-guide?srsltid=AfmBOooUVAqWvBVMgBY4UfuIO_bEJEs9QeXNS2rHIuY_cf1K6KIMky-p>.
(Continued)

*Primary Examiner* — Linda J. Hodge
(74) *Attorney, Agent, or Firm* — Dunlap Bennett & Ludwig PLLC; Anna L. Kinney

(57) ABSTRACT

A creasing device for preparing creased fabric strips includes an upper housing member and a lower housing member joined together by a hinge assembly. The housing members have a pair of opposed guide surfaces and at least one creasing ridge adjacent to one of the guide surfaces. The housing members can be rotated with respect to each other from an open position to a closed position. The creasing device has a latch assembly that secures the housing members together in the closed position. A method of preparing creased fabric strips with the creasing device includes disposing a folded first end of a fabric strip in the device; drawing the fabric strip over the creasing ridge to impart a longitudinal crease in the fabric strip; and extending the fold from the folded first end along a length of the fabric strip as it is passed through the device.

20 Claims, 6 Drawing Sheets

(56) References Cited

U.S. PATENT DOCUMENTS

| | | | | |
|---|---|---|---|---|
| 2002/0124299 | A1* | 9/2002 | Malcolm | A61F 9/025 2/439 |
| 2003/0125179 | A1* | 7/2003 | Evans | B65H 45/221 493/405 |
| 2010/0292064 | A1* | 11/2010 | Hatcher | B65H 45/08 223/37 |
| 2022/0218083 | A1* | 7/2022 | Wright | A45C 13/005 |

OTHER PUBLICATIONS

International Search Report and Written Opinion; PCT/US2024/047462; Mailed Dec. 17, 2024.

* cited by examiner

MAGIC BINDING MAKER

CROSS-REFERENCE TO RELATED APPLICATION

This application claims the benefit of priority of U.S. provisional application No. 63/583,704, filed Sep. 19, 2023, the contents of which are herein incorporated by reference.

TECHNICAL FIELD

The present invention relates generally to quilt-making and in particular to a method and device for preparing binding for quilts involving creasing a folded fabric strip without the use of an ironing device.

BACKGROUND OF THE INVENTION

Quilts are prepared using a plurality of layers, including a woven cover sheet, a woven backing sheet and batting therebetween. Typical construction also includes a binding which is a cloth or other type of creased strip secured to the periphery of the quilt in order to bind the various layers together and prevent separation during use.

In the prior art, cloth binding strips are folded and creased with an iron or other heating device. Some seamstresses also use a thumbnail to crease the folded fabric, but this method requires a relatively high level of skill and is subject to variations in the creased product which can be wasteful and/or unsightly in the finished quilt.

SUMMARY OF INVENTION

The present invention utilizes a creasing device to impart a crease to a folded fabric strip by way of feeding the folded fabric strip to the device, advancing the folded fabric strip between an opposed pair of guiding surfaces and drawing the folded fabric strip over one or more creasing ridges before the strip exits the device, preferably in the absence of heating the strip. The guiding surfaces typically are adjacent to a pair of perpendicular edge guides to further guide the strip through the device and provide uniformity to the creased strip.

In an aspect of the present invention, a creasing device for preparing creased fabric strips comprises an upper housing member as well as a lower housing member joined together by a hinge assembly, such that the upper and lower housing members can be rotated with respect to each other from an open position to a closed position and wherein the upper and lower housing members have a pair of opposed guide surfaces and at least one creasing ridge adjacent one of the guide surfaces; and a latch assembly securing the housing members together in a closed position.

In another aspect of the present invention, a method of preparing creased fabric strips comprises disposing a folded first end of a fabric strip in a creasing device having a creasing ridge; drawing the fabric strip over the creasing ridge to impart a longitudinal crease in the fabric strip; and extending the fold from the folded first end along a length of the fabric strip as it is passed through the creasing device.

A typical construction of the device includes an upper housing member with a guide surface hinged to a lower housing member with another guide surface so that the device may be opened or closed, and one or more latches for securing the upper and lower housing members together in a closed position where the device has a feed opening and a binding exit. A pair of edge guides perpendicular to the guide surfaces keep the strip on track while it is drawn through the device over one or more creasing ridges so that the folded strip maintains the desired orientation with respect to the device.

Inasmuch as it is common to stitch strips together for longer lengths of binding, the latch or latches are preferably resilient or elastomeric, for example, silicone rubber, such that the device has some "give" so that it can accommodate the added thickness of a stitched-on strip extension without jamming as the strip is drawn through the device.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a creasing device operative to crease a folded fabric strip without the need for an iron or other heating device.

Figure 1A:
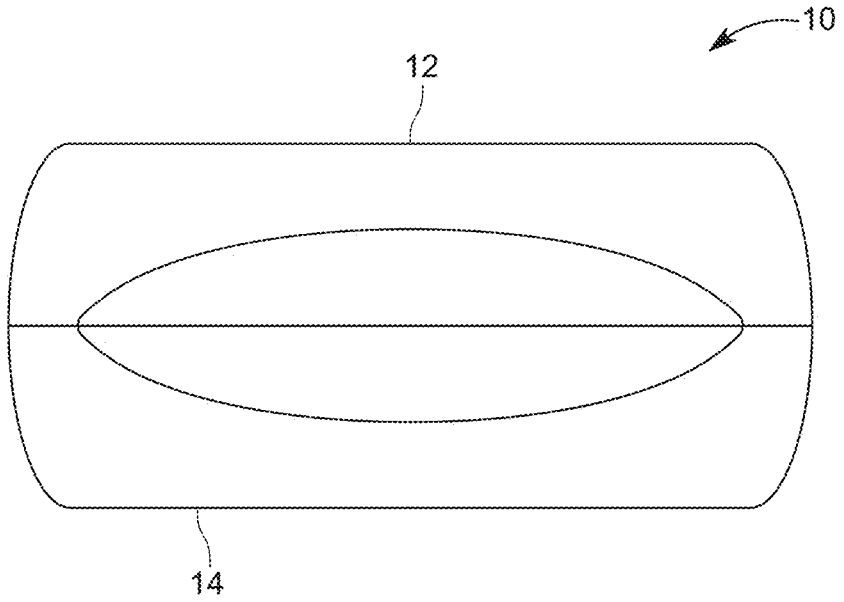
FIG. 1A is a front elevation view of a creasing device according to an embodiment of the present invention, shown in a closed position.
Figure 1B:
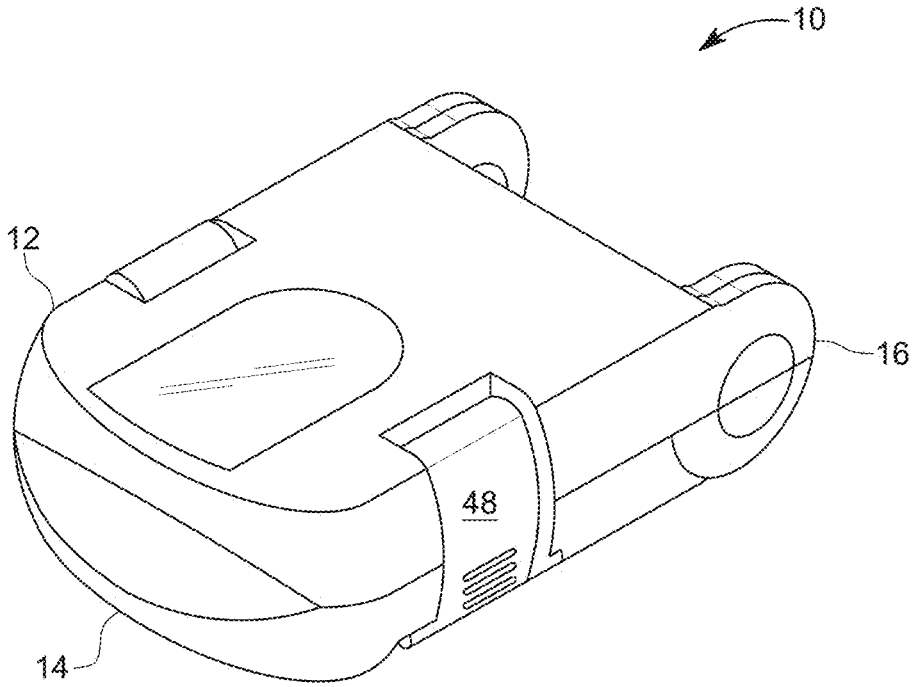
FIG. 1B is a perspective view thereof.
Figure 1C:
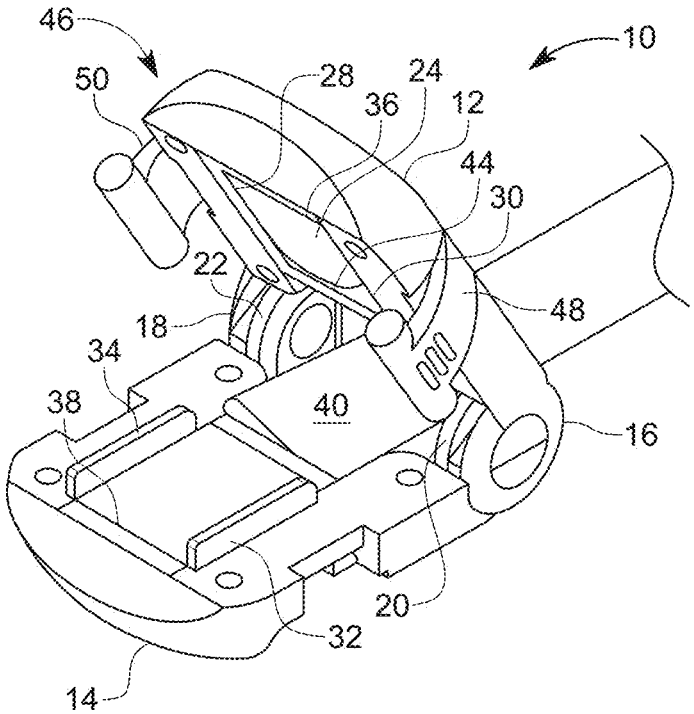
FIG. 1C is another perspective view thereof, shown in use in an open position.
Figure 1D:
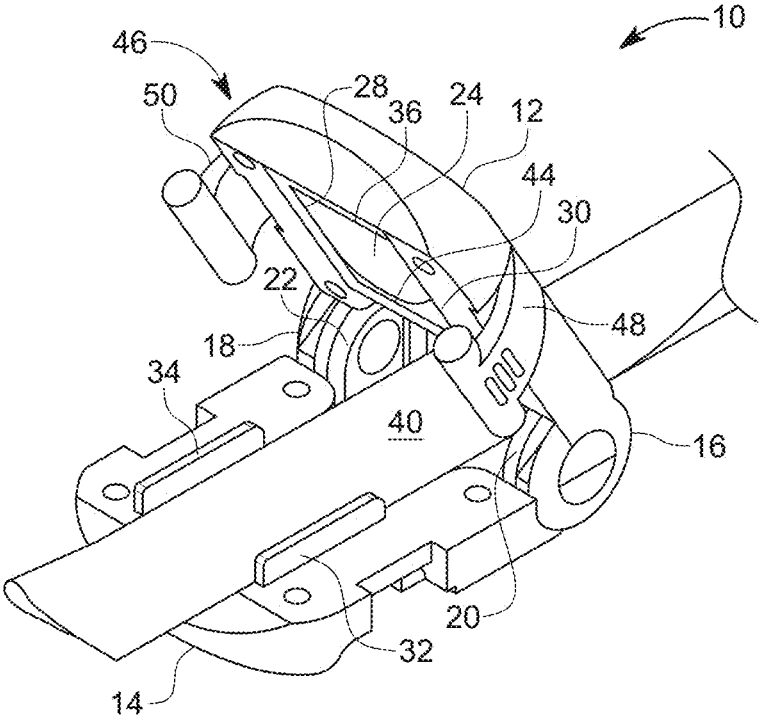
FIG. 1D is another perspective view thereof.
Figure 1E:
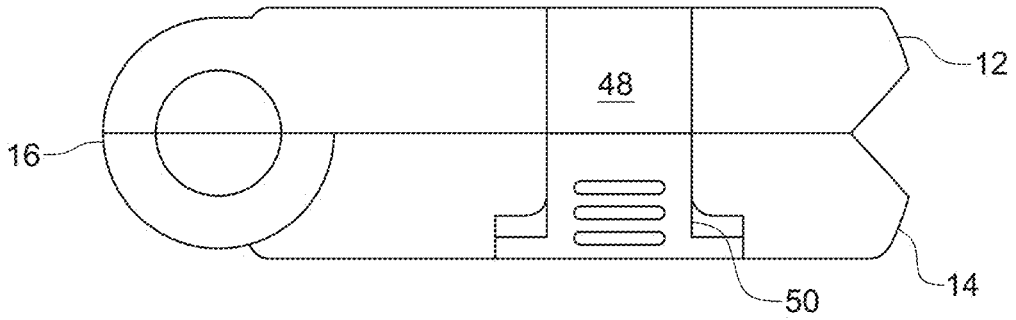
FIG. 1E is a left side elevation view thereof.
Figure 1F:
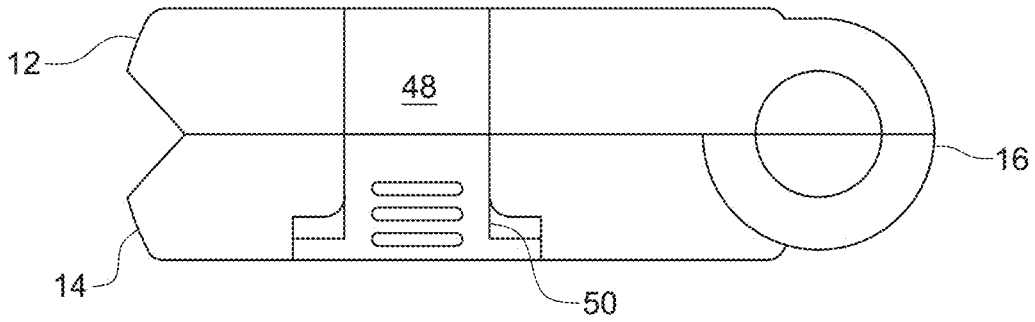
FIG. 1F is a right side elevation view thereof.
Figure 2A:
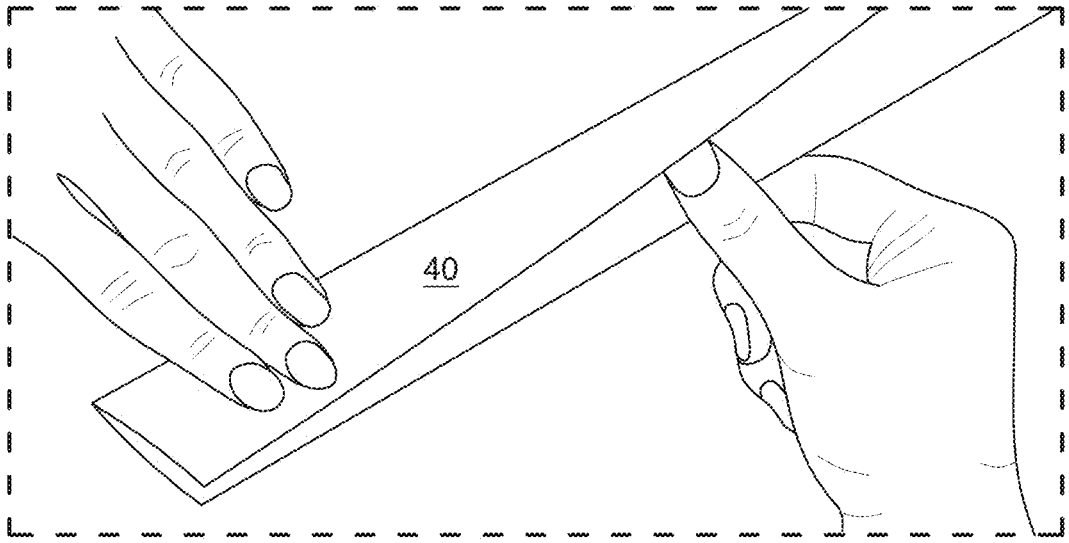
FIG. 2A is a folding step in a method of creasing fabric according to an embodiment of the present invention.
Figure 2B:
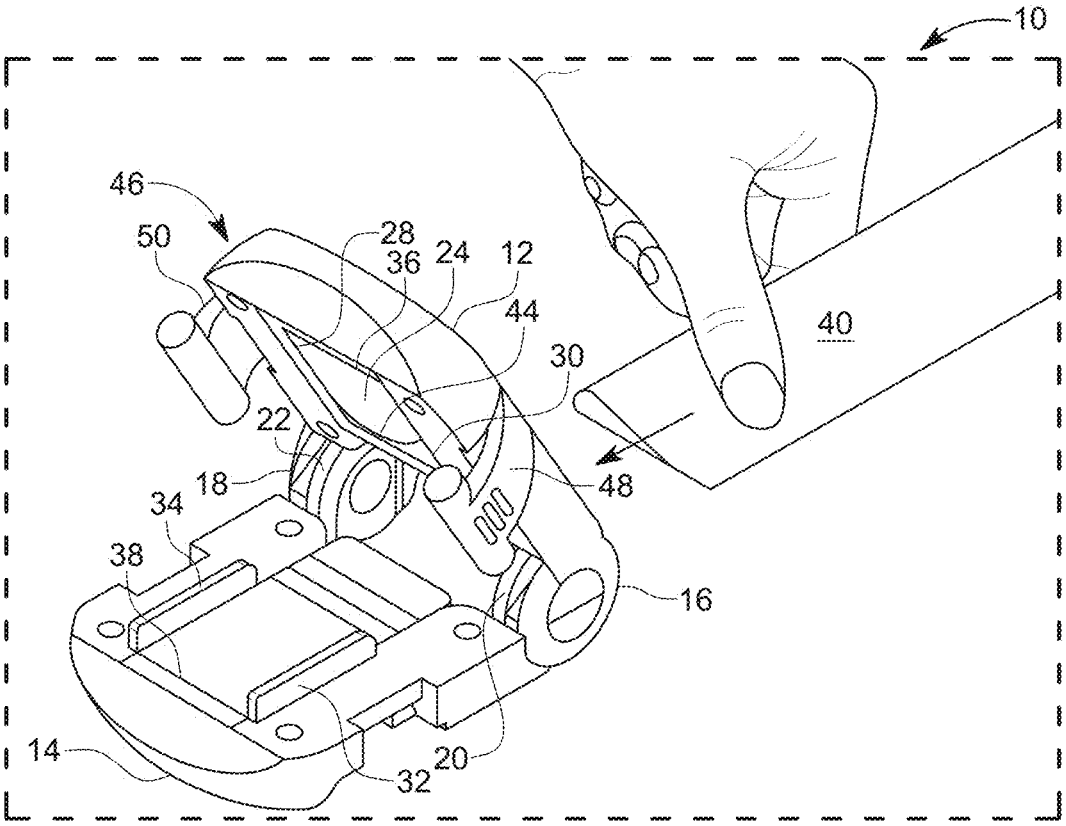
FIG. 2B is an insertion step thereof into the creasing device of FIG. 1A.
Figure 2C:
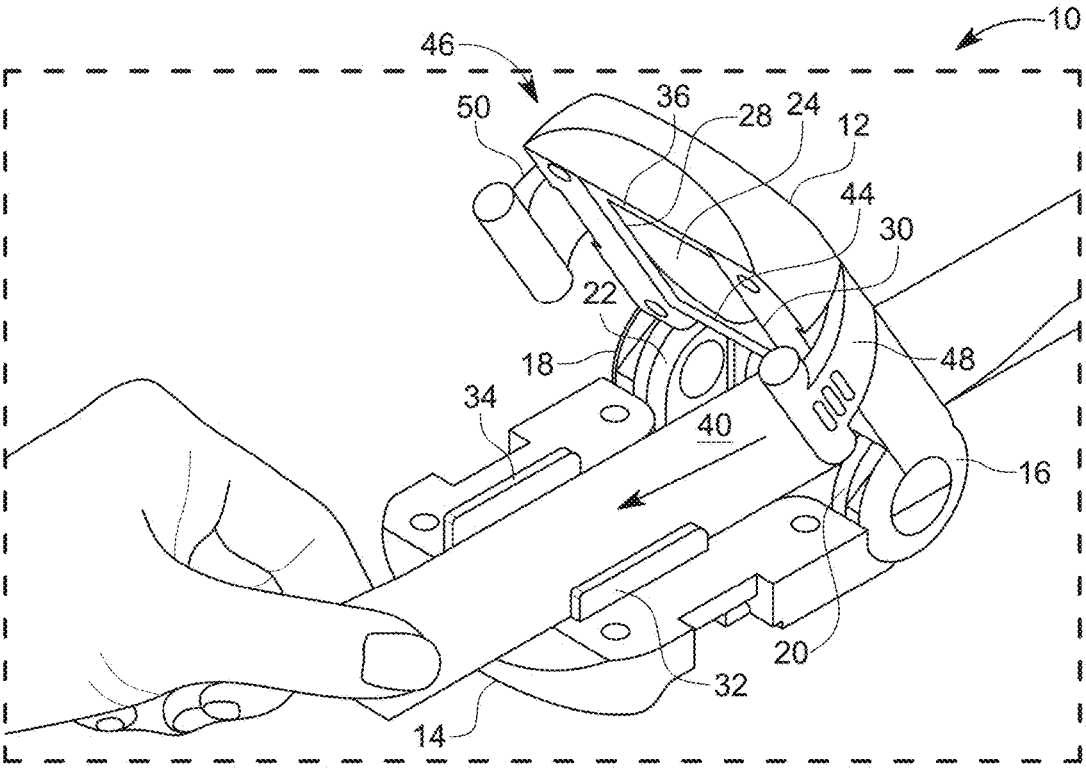
FIG. 2C is a positioning step thereof.
Figure 2D:
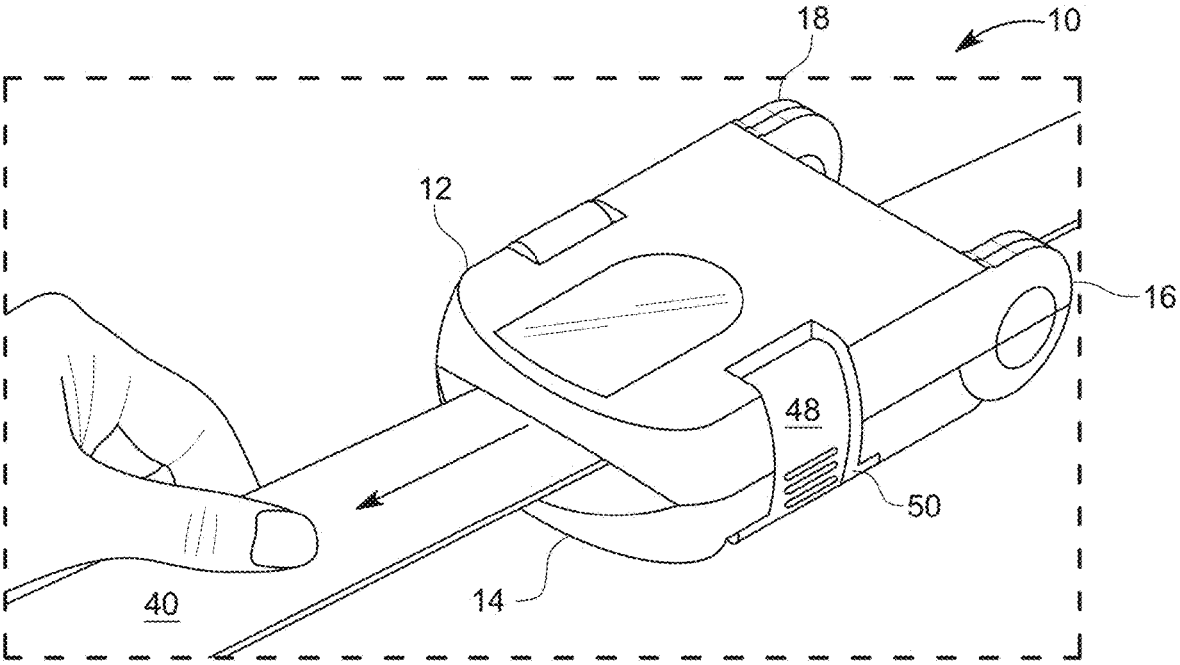
FIG. 2D is a creasing step thereof.
Figure 3:
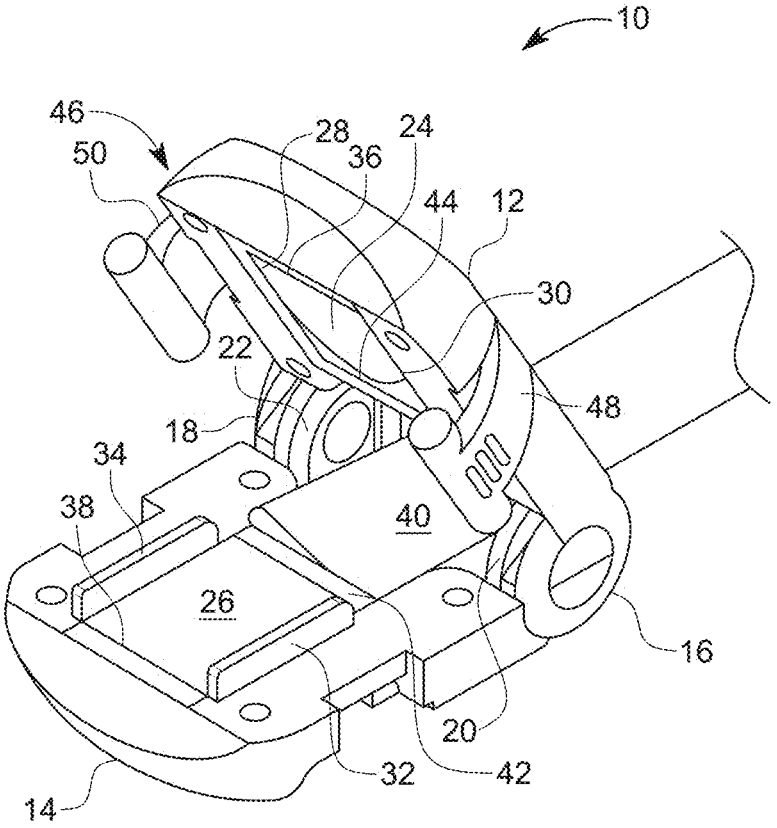
FIG. 3 is a detail view of the creasing device of FIG. 1A.

The invention is described in detail in connection with the drawings below wherein FIGS. 1A through 1F show various views of the creasing device, FIGS. 2A through 2D illustrate operation of the creasing device and FIG. 3 is an enlarged version of FIG. 1C with labels indicating salient parts.

Referring to the drawings there is shown a creasing device 10 comprising an upper housing member 12 as well as a lower housing member 14. The upper housing member has a pair of outer hinge elements 16, 18 coupling it to the lower housing member with inner hinge elements 20, 22. The housing members have a pair of opposed guide surfaces 24, 26. Surface 24 of upper housing member 12 has a pair of slots 28, 30 provided to accommodate a pair of perpendicular edge guides 32, 34 provided on lower housing member 14. Upper housing member 12 has a creasing ridge 36 at a forwardmost position of guide surface 24, while lower housing member 14 has a creasing ridge 38 at a forwardmost position of guide surface 26. Ridges 36, 38 project away from their adjacent guide surfaces a slight distance on the order of a millimeter or so (0.5 to 3 millimeters typically) to provide a crease to a folded fabric strip 40 as is discussed below and illustrated in FIG. 2.

To facilitate passage of the fabric strip, a pair of rollers 42, 44 adjacent rearwardmost positions of the guide surfaces are provided which form a roller nip when the device is in a closed position.

Also provided is a latch assembly 46 which is used to secure the upper housing member to the lower housing member in a closed position. Preferably, the latch assembly is resilient or elastomeric in order to accommodate a stitched (double thickness) fabric strip which may be used because a quilt may be of larger dimensions than the fabric source. To this end, the latch assembly may be constructed in the form of silicone rubber bands indicated at 48, 50.

Operation of the device is described with reference to FIGS. 2A through 2D. In FIG. 2A, there is shown a folded fabric strip prior to creasing. In FIGS. 2B and 2C the folded strip is fed to the creasing device from a feed entrance at the rear portion of the device in an open position. In FIG. 2D the device is latched to a closed position over the strip such that the creasing edges engage the strip which is subsequently drawn over the creasing edges to crease the fold into the strip to produce the creased binding strip which is extracted from an exit of the device as shown. It will be appreciated from the diagrams that it is only necessary to fold the strip at one end, since the device will automatically fold the strip as additional length is drawn through the creasing device.

It should be understood, of course, that the foregoing relates to exemplary embodiments of the invention and that modifications may be made without departing from the spirit and scope of the invention as set forth in the following claims.

What is claimed is:

1. A method of preparing creased fabric strips, comprising:

disposing a folded first end of a fabric strip in a creasing device having a creasing ridge;

wherein the creasing device comprises:

(a) an upper housing member as well as a lower housing member joined together by a hinge assembly, such that the upper and lower housing members can be rotated with respect to each other from an open position to a closed position and wherein the upper and lower housing members have a pair of opposed guide surfaces including an upper guide surface and a lower guide surface and the creasing ridge is adjacent one of the opposed guide surfaces, the at least one creasing ridge projecting away from the adjacent one of the opposed guide surfaces;

wherein the fold of the first end of the fabric strip extends along a longitudinal direction of the fabric strip, and wherein the creasing ridge is transverse to the fold in the fabric strip;

drawing the folded fabric strip in a creasing direction over the transverse creasing ridge to crease the fold into the fabric strip to produce the creased fabric strip with a longitudinal crease; and extending the fold from the folded first end along a length of the fabric strip as it is passed through the creasing device.

2. The method according to claim 1, wherein the creasing device comprises:

a latch assembly securing the upper and lower housing members together in the closed position.

3. The method according to claim 2, wherein the latch assembly is resilient and includes an elastomeric band which secures the upper and lower housing members together in the closed position along a first lateral side of the closed creasing device aligned with the creasing direction.

4. The method according to claim 3, wherein the latch assembly includes another elastomeric band which secures the upper and lower housing members together in the closed position along a second lateral side of the closed creasing device aligned with the creasing direction, said second lateral side of the closed creasing device being opposite the first lateral side of the closed creasing device aligned with the creasing direction.

5. The method according to claim 4, wherein the elastomeric bands are formed of silicone rubber.

6. The method according to claim 2, wherein the creasing device further comprises at least one additional transverse creasing ridge adjacent the other of the opposed guide surfaces at a forwardmost position with respect to the opposed guide surfaces.

7. The method according to claim 6, wherein the creasing ridges project away from their adjacent guide surfaces a distance of from 0.5 mm to 3 mm.

8. The method according to claim 2, wherein one of the upper and lower housing members has a pair of slots positioned adjacent one of said upper and lower guide surfaces and configured to accommodate a pair of perpendicular edge guides disposed on the other housing member adjacent the other one of said pair of said upper and lower guide surfaces.

9. The method according to claim 2, wherein a pair of rollers adjacent rearwardmost positions of the opposed guide surfaces are provided which form a roller nip when the creasing device is in the closed position.

10. The method according to claim 1, wherein the creasing ridge is oriented perpendicular to the creasing direction.

11. The method according to claim 1, wherein the creased fabric strip is divided into 2 equal parts by the longitudinal crease.

12. The method according to claim 1, wherein the fold in the fabric strip is creased into the fabric strip without application of heat.

13. A creasing device for preparing creased fabric strips comprising:

(a) an upper housing member as well as a lower housing member joined together by a hinge assembly, such that the upper and lower housing members can be rotated with respect to each other from an open position to a closed position and wherein the upper and lower housing members have a pair of opposed guide surfaces including an upper guide surface and a lower guide surface and at least one creasing ridge adjacent one of the opposed guide surfaces transverse to a creasing direction, the at least one creasing ridge projecting away from the adjacent one of the opposed guide surfaces; and (b) a latch assembly securing the upper and lower housing members together in the closed position wherein the creasing device is adapted to produce a creased fabric strip with a longitudinal crease by way of (i) disposing a folded first end of a fabric strip in the creasing device such that the fold of the first end of the fabric strip extends along a longitudinal direction of the fabric strip;

(ii) wherein the at least one creasing ridge is transverse to the fold in the fabric strip; and (iii) drawing the fabric strip in the creasing direction over the at least one transverse creasing ridge to crease the fold into the fabric strip to produce the creased fabric strip with a longitudinal crease.

14. The creasing device according to claim 13, wherein the latch assembly is resilient and includes an elastomeric band which secures the upper and lower housing members together in the closed position along a first lateral side of the closed creasing device aligned with the creasing direction.

15. The creasing device according to claim 14, wherein the latch assembly includes another elastomeric band which secures the upper and lower housing members together in the closed position along a second lateral side of the closed creasing device aligned with the creasing direction, said second lateral side of the closed creasing device being opposite the first lateral side of the closed creasing device aligned with the creasing direction.

16. The creasing device according to claim 15, wherein the elastomeric bands are formed of silicone rubber.

17. The creasing device according to claim 13, wherein the at least one creasing ridge comprises creasing ridges adjacent both of the opposed guide surfaces at a forwardmost position with respect to the opposed guide surfaces.

18. The creasing device according to claim 13, wherein one of the upper and lower housing members has a pair of slots positioned adjacent one of said upper and lower guide surfaces and configured to accommodate a pair of perpendicular edge guides disposed on the other housing member adjacent the other one of said pair of said upper and lower guide surfaces.

19. The creasing device according to claim 13, wherein a pair of rollers adjacent rearwardmost positions of the opposed guide surfaces are provided which form a roller nip when the creasing device is in the closed position.

20. The creasing device according to claim 13, wherein the creasing device is adapted to crease the fold into the fabric strip without application of heat.

* * * * *